United States Patent [19]

Swartzbaugh

[11] Patent Number: 4,620,640

[45] Date of Patent: Nov. 4, 1986

[54] LINED CHILD-RESISTANT CLOSURE FOR WIDEMOUTH LIQUID CONTAINER

[75] Inventor: Peter T. Swartzbaugh, Toledo, Ohio

[73] Assignee: Owens-Illinois, Inc., Toledo, Ohio

[21] Appl. No.: 809,607

[22] Filed: Dec. 16, 1985

[51] Int. Cl.[4] ..... B65D 55/02

[52] U.S. Cl. ..... 215/217; 215/222

[58] Field of Search ..... 215/217, 220, 222

[56] References Cited

U.S. PATENT DOCUMENTS

| | | | |
|---|---|---|---|
| 3,952,899 | 4/1976 | Cooke | 215/217 |
| 4,139,112 | 2/1979 | Cooke | 215/217 |
| 4,275,817 | 6/1981 | Patton | 215/222 |
| 4,387,817 | 6/1983 | Wiles et al. | 215/217 |

*Primary Examiner*—George T. Hall

*Attorney, Agent, or Firm*—John R. Nelson

[57] ABSTRACT

A liquid-tight child-resistant package that includes a glass or plastic container of the wide mouth type (i.e., with a container finish "T" dimension of at least 33 millimeters) and a complementary molded thermoplastic closure that utilizes a separate disk-type liner. The closure which, with the exception of the separate liner, is molded in one piece, has a multiple helical thread start, and each closure thread has a vertically extending shoulder on its upper side. Each complementary container finish thread has a vertically extending shoulder that engages the corresponding shoulder on the closure, after the partial unscrewing of the closure, to prevent further unscrewing of the closure until the closure is vertically depressed on the container finish, against the spring action of the closure liner, to separate the shoulder on the closure thread from the shoulder on the container thread and to thereby permit continuation of the unscrewing of the closure until it can be removed from the container. The container also has a series of threadlike projections below the container threads and the closure thread is received in helical slots between the container threads and the threadlike projections. The threadlike projections help to positively lift the closure off the container finish during the opening of the container.

21 Claims, 10 Drawing Figures

LINED CHILD-RESISTANT CLOSURE FOR WIDEMOUTH LIQUID CONTAINER

BACKGROUND OF THE INVENTION

1. Field of the Invention

This invention relates to a closure for a container that is adapted to contain a liquid, the closure and the container having cooperating features which impart child-resistant opening characteristics to the package which includes such closure and container, to help to prevent the accidental ingestion of the contents of the container by children. The closure has a separate liner which seals against the container to prevent the leakage or spillage of the contents of the closed container. The closure is designed for use with wide mouth containers, viz., those having a finish dimension ("T" dimension) of at least 33 millimeters.

2. Description of the Prior Art

Various types of child-resistant opening packages are known in the prior art, and certain of such packages include a closure and a container that engage one another in a liquid-tight seal to permit the packaging of a liquid in such container, with the assurance that the liquid will not leak or spill from the container if the container is lying on its side, so long as the closure is securely affixed to the container. For example, U.S. Pat. No. 4,375,858 (H. D. Shah, et al) discloses a child-resistant package in which the closure is of the self-sealing or linerless type, and U.S. Pat. Nos. 3,610,454 (D. M. Malick), 3,952,899 (C. W. Cooke), and 3,979,001 (C. Bogert) disclose child-resistant packages that utilize closures having resilient gaskets to permit such closures to seal against the associated containers. Closures of the aforesaid child-resistant types can be difficult to remove by adults, however, especially by adults who suffer from hand function impairment as a result of arthritis or hand injury, for example, and this problem is more serious in the case of child-resistant packages that utilize wide mouth containers.

SUMMARY OF THE INVENTION

In accordance with the present invention there is provided a child-resistant container/closure package in which the container is of the wide mouth type, that is, with a container finish diameter, viz., with a container "T" dimension (the approximate outside diameter of the container thread) of at least 33 millimeters. The finish of the container of the package of the present invention has a pair of sets of helically extending threadlike projections extending radially outwardly from the finish. The first set of threadlike projections is positioned above the second set or, in other words, closer to the rim at the mouth of the container. The first set, which functions as a multiple start container thread, is made up of at least a pair of partial thread segments which are disposed in a circumferential pattern on separate helixes. Each of the thread segments in the first set has a vertically extending shoulder formed in the upper side thereof. The second set of threadlike projections is disposed below the first set and defines a circumferential series of helical slots with the first set of threadlike projections.

The closure of the present invention is a two-piece closure which is made up of a molded thermoplastic closure body, including a top panel, a skirt and a multiple start closure thread that is engageable with the first set of threadlike projections on the container finish to permit the closure to be screwed onto and off the container finish. The second piece of the two-piece closure is a springable liner that is inserted into the closure body, near the inside of the top panel, to form a seal between the inside of the top panel of the closure and the rim of the container when the closure is screwed tightly down on the container finish. Each of the segments of the multiple thread start closure thread has a vertically extending shoulder formed in the lower side thereof. The shoulders in the closure thread segments engage the shoulders in the container thread segments after the closure has been partially unscrewed from the container finish to prevent further unscrewing of the closure, and to thereby help to prevent accidental removal of the closure by children unless and until the closure is manually depressed relative to the container finish, a step which will separate the shoulders on the closure thread segments from the shoulders on the container thread segments and will then permit continued unscrewing of the closure to complete the removal process.

The closure is normally resiliently biased upwardly away from the finish by the closure sealing liner to insure that the shoulders in the closure thread segments engage the shoulders in the container thread segments unless and until the closure is manually depressed, against the biasing force of the closure liner. The sealing and biasing effects of the closure liner are obtained through the use of a multilayer, disk-type liner, such liner using a thin layer of a sealing material, such as a thin foam plastic material, backed-up by a thicker layer of a plastic sheet material that acts like a disk spring. A central portion of such a liner is maintained below the level of the inside of the closure top panel by a projection on the inside of the top panel, and this placement of the closure liner allows an annular edge portion of the liner to be flexed upwardly, relative to the central portion, to be compressed against the inside of the closure top panel when the closure is screwed tightly against the container finish, thus, distorting the plastic sheet material in the closure liner and creating the proper biasing force on the closure by virtue of such distortion of the closure liner.

Accordingly, it is an object of the present invention to provide an improved child-resistant container/closure package.

It is a further object of the present invention to provide a child-resistant container/closure package that may utilize a wide mouth container.

It is a further object of the present invention to provide a child-resistant container/closure package in which the container is of the wide mouth type and in which the closure may be mass produced relatively inexpensively by the molding of a thermoplastic material.

It is a further object of the present invention to provide a child-resistant container/closure package in which the container is of the wide mouth type, and which may be utilized in the packaging of a liquid.

It is also a further object of the present invention to provide a child-resistant container/closure package in which the container is of the wide mouth type and is readily formable from plastic by various of the known plastic container manufacturing techniques.

It is also an object of the present invention to provide a child-resistant container/closure package in which the container is of the wide mouth type and which incorporates a feature to assist in the removal of the closure from the container by a person with an injured or arthritic hand.

It is also an object of the present invention to provide a child-resistant container/closure package in which the container is of the wide mouth type, which may be utilized for the packaging of a liquid, and in which the closure, when in sealing engagement with the container, is pulled down against the container at a multiplicity of points around the container to insure good sealing of the closure to the container around the circumference of the container.

It is also an object of the present invention to provide an improved wide mouth container which may be utilized with a suitable closure to provide a child-resistant container/closure package for the packaging of a liquid.

It is also an object of the present invention to provide an improved closure for use with a suitable wide mouth container to provide a child-resistant container/closure package for the packaging of a liquid.

For further understanding of the present invention and the objects thereof, attention is directed to the drawing in the following description thereof, to the detailed description of the invention, and to the appended claims.

DETAILED DESCRIPTION OF THE INVENTION

Figure 1:
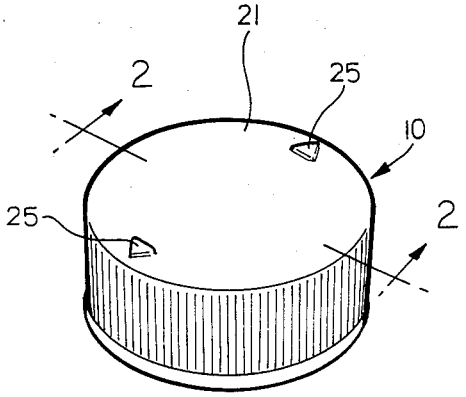
FIG. 1 is a top perspective view of the preferred embodiment of a closure according to the present invention, which closure has utility in combination with a suitable container in the preferred embodiment of a package according to the present invention.
Figure 2:
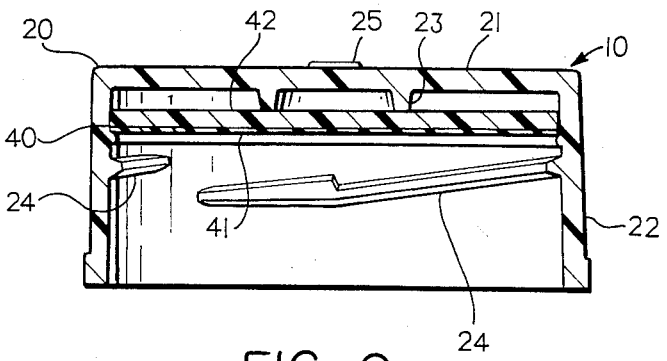
FIG. 2 is a sectional view, at an enlarged scale, taken on line 2—2 of FIG. 1.

The child-resistant package according to the present invention is made up of a closure, indicated generally by reference numeral 10, and a container, shown fragmentarily and indicated generally by reference numeral 50. The package that includes the closure 10 and the container 50 may be used to package a liquid product, identified generally by reference character P in FIGS. 7, 8, and 9. As is shown in FIG. 2, the closure 10 is made up of a closure body 20 and a liner 40. The closure body 20 is preferably molded in a single piece, as by injection molding or compression molding, from a suitable thermoplastic material, such as high density polyethylene or polypropylene. The liner 40 is of a composite or multi layer construction which includes a lower layer 41 of a suitable pulp or plastic material for sealing against the container 50, such as a foam plastic material, and an upper layer 42 of a springable material, such as a sheet-like plastic material, the upper layer 42 being in surface-to-surface contact with the lower layer 41, and preferably being adhesively or other wise securely bonded thereto. The container 50 is a wide mouth container, having a container "T" dimension of 33 millimeters or greater, and may be considered to be either a blown glass container or a blow molded thermoplastic container, the selection of material for the container 50 normally being based on the susceptibility of the contents of the container to attack by oxygen or other ingredients which may permeate through the wall of a plastic container, or to infra-red or ultra-violet radiation which may pass through the wall of the glass container, all as is well understood in the art.

Figure 8:
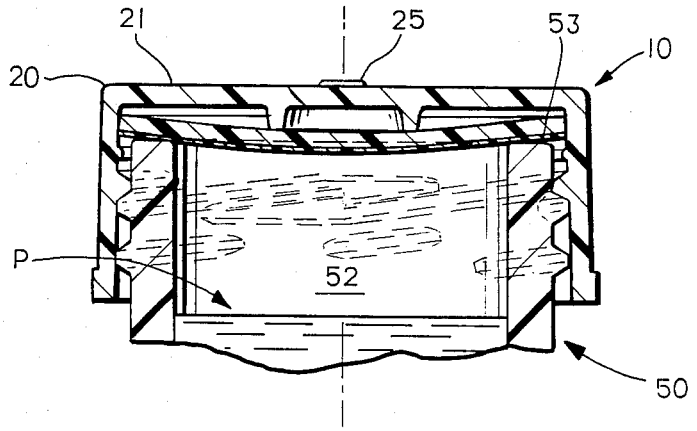
FIG. 8 is a view similar to FIG. 7 showing the closure in relationship to the container after the closure has been partially unscrewed from the container, as part of the process of removing the closure from the container.

The container 50 has a neck or "finish" portion 51 that defines an upper open mouth 52 of the container, as shown in FIG. 8, the "finish" portion 51 terminating in a rim 53.

The closure body 20 is made up, in general, of a top panel 21 that spans the upper open mouth 52 of the container 50 when the closure is applied to the container 50, and an annular skirt 22 that extends downwardly from the top panel 21 to surround the finish 51 of the container 50 when the closure is applied to the container 50. The closure body 20 also has a centrally located and downwardly depending projection 23, which preferably is annular in configuration, and which maintains at least the central portion of the liner 40 at an elevation beneath the underside of the top panel 21 of the closure body 20. When the closure 10 is securely applied to the container 50, as is shown in FIG. 7, an outer annular portion of the liner 40, by virtue of its engagement with the rim 53 of the container 50, relative to the central portion of the liner 40, is maintained at a lower elevation by its contact with the projection 23 of the closure body 20, thus distorting the liner 40 and, as a result of such distortion, a resilient biasing force is created in the liner 40 that tends to bias the closure 10 upwardly from the finish 51 of the container 50 for purposes which will be subsequently described more fully.

The finish 51 of the container 50 is provided with a first series of threadlike projections 54 which are formed integrally with the finish 51 and which project radially outwardly therefrom. The threadlike projections 54 are arrayed in a circumferential pattern extending around the finish 51, and each of the threadlike projections 54 has a leading edge **54*a* and a trailing edge 54*b*. Each threadlike projection 54 extends at a helical angle with respect to the rim 53 of the container finish 51, and the threadlike projections 54 are positioned in spaced-apart or non-overlapping relationship relative to one another, with the trailing edge 54*b* of any given projection 54 defining an open space 54***c* with the leading edge 54*a* of the next threadlike projection 54 in the circumferential array of such threadlike projections. Together, the threadlike projections 54 form a multiple start closure receiving thread for the container 50, with each such threadlike projection 54, two of which are shown in the container of Figures 5 through 10, lying on a separate helical angle with respect to the rim 53 of the container 50. Each threadlike projection 54 is irregular in configuration, to define a generally vertically extending shoulder 54*d* that extends from the underside of such threadlike projection 54.

The closure body 20 of the closure 10 of the present invention also has a generally circumferentially disposed series of threadlike projections 24, which are formed integrally with the closure body 20 and which project radially inwardly from the inside of the skirt 22. Each closure threadlike projection 24 has a leading edge 24*a* and a trailing edge 24*b* and the closure threadlike projections 24 are disposed in spaced-apart or nonoverlapping relationship so that the trailing edge 24*b* of any particular closure threadlike projection 24 defines a space 24*c* with respect to the leading edge 24*a* of the next closure threadlike projection 24. Each closure threadlike projection 24 is irregular in configuration to define a generally vertically extending shoulder 24*d* that extends generally vertically upwardly from the top of such closure threadlike projection 24. The closure threadlike projections 24, each of which extends at a helical angle with respect to the rim 53 of the container to which such closure is to be applied, form a multiple start closure thread which is complementary to the multiple start container thread formed by the container threadlike projections 54, to permit the closure 10 to be applied to the container by screwing it onto the finish 51 of the container, and to be removed from the container 50 by unscrewing it from the container finish 51.

Figure 7:
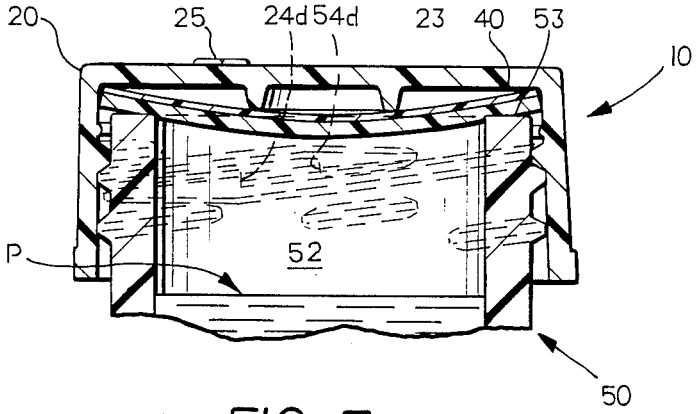
FIG. 7 is a fragmentary elevational view, in section, showing the closure of FIGS. 1 through 4 in tight, sealing engagement with the container of FIGS. 5 and 6.
Figure 9:
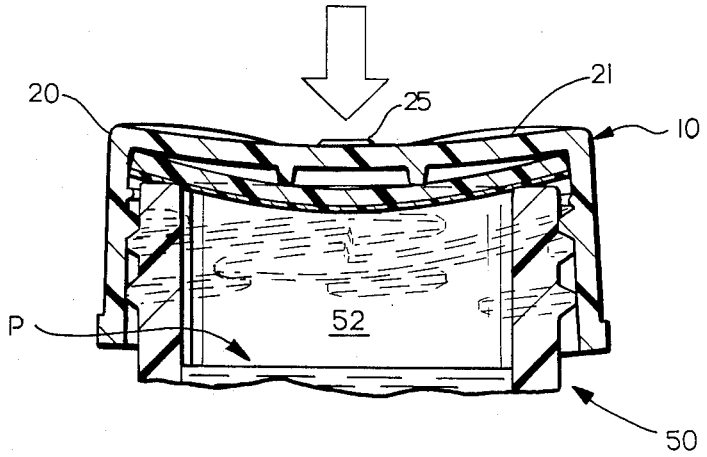
FIG. 9 is a view similar to FIGS. 7 and 8 which illustrates the step which must be performed, after the closure has reached the condition shown in FIG. 8, before the closure can be further removed from the container.
Figure 10:
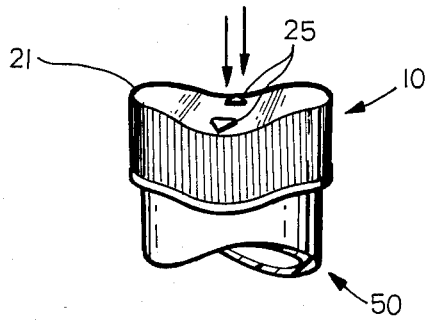
FIG. 10 is a fragmentary top perspective view which shows the closure and the container during the performance of the removal step shown in FIG. 9.

As is shown in FIG. 7, when the closure 10 is tightly applied to the container 50, the shoulder 24*d* of the closure threadlike projections 24 will override the shoulders 54*d* of the container threadlike projections 54, so that, as is shown in FIG. 8, the closure 10 can be partially unscrewed from the container 50 without the need for any special manipulation of the closure 10 to permit such partial unscrewing of the closure 10 from the container 50. As is shown in FIG. 8, during the unscrewing of the closure 10 from the container 50, a point will be reached where there is interference between each shoulder 24*d* of a closure threadlike projection 24 and a corresponding shoulder 54*d* of a container threadlike projection 54, at which time no further unscrewing of the closure 10 can occur until the shoulders 24*d* of the closure threadlike projections 24 are separated from the shoulders 54*d* of the container threadlike projections 54. As is shown in FIG. 9, the shoulders 24*d* can be separated from the shoulders 54*d* by the application of a vertically downwardly directed force on the top panel 21 of the closure 20 at locations that are aligned with the shoulders 24*d* of the closure threadlike projection 24, the closure top panel 21 being provided with externally apparent indicia, such as upwardly projecting, arrow-shaped projections 25, to indicate the locations for the application of such vertically downwardly directed force.

The application of vertically downwardly directed force at the arrow-shape projections 25 will downwardly depress the center of the liner 40 of the closure 10, against the upwardly directed biasing force imparted by the upper layer 42 of the closure liner 40, and upon the removal of such vertically downwardly directed force, the top panel 21 will be returned to the position shown in FIG. 8 by virtue of such biasing force in the liner 40 of the closure 10. So long as the vertically downwardly directed force against the arrow-shaped projections is sufficient to permit the separation of the shoulders 24*d* of the closure threadlike projections 24 from the shoulders 54*d* of the container threadlike projections 54, the unscrewing of the closure 10 from the container 50 can proceed to completion. The need to downwardly deflect the top panel 21 of the closure body 10 during the unscrewing of the closure 10 from the container 50 creates the need for the performance of a manipulative step which is not obvious to a child, and thereby imparts resistance to opening of the package that includes the closure 10 securely applied to the container 50, which resistance is especially effective insofar as children are concerned, and thereby it helps to prevent the accidental or inadvertent consumption of the contents P of the container 50.

Figure 3:
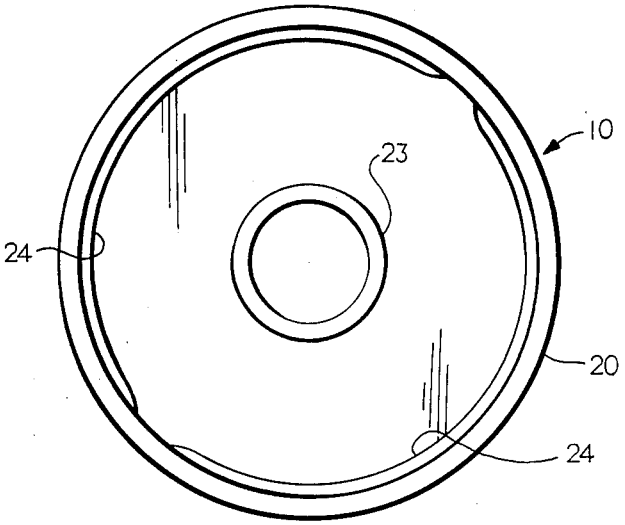
FIG. 3 is a bottom plan view of the closure of FIGS. 1 and 2, with an element of the closure shown in FIG. 2 being removed for the sake of clarity.
Figure 4:
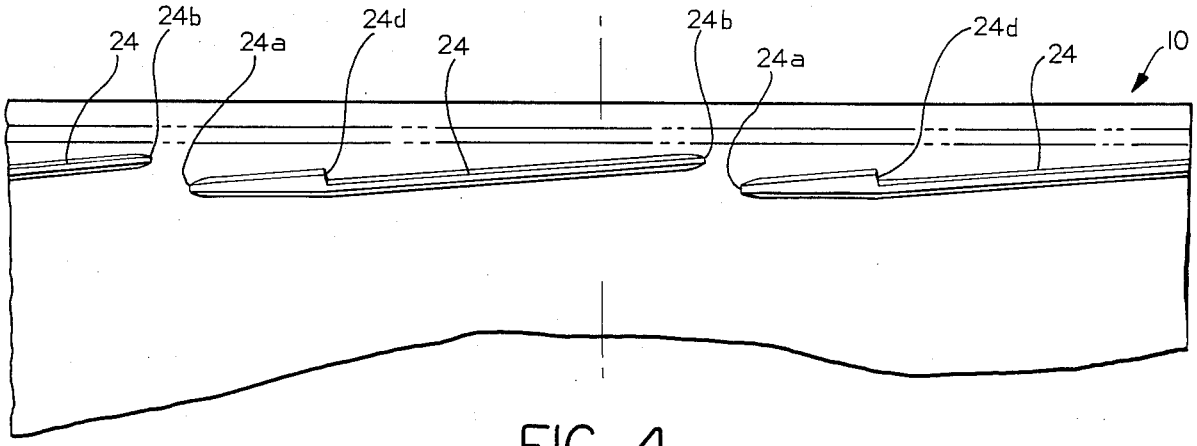
FIG. 4 is a fragmentary development view of the closure of FIGS. 1 through 3.
Figure 5:
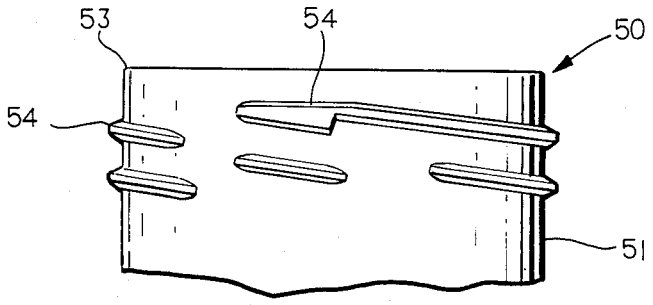
FIG. 5 is a fragmentary elevational view of a preferred embodiment of a container according to the present invention, which container has utility in combination with the closure of FIGS. 1 through 4 to form the preferred embodiment of a child-resistant package according to the present invention.
Figure 6:
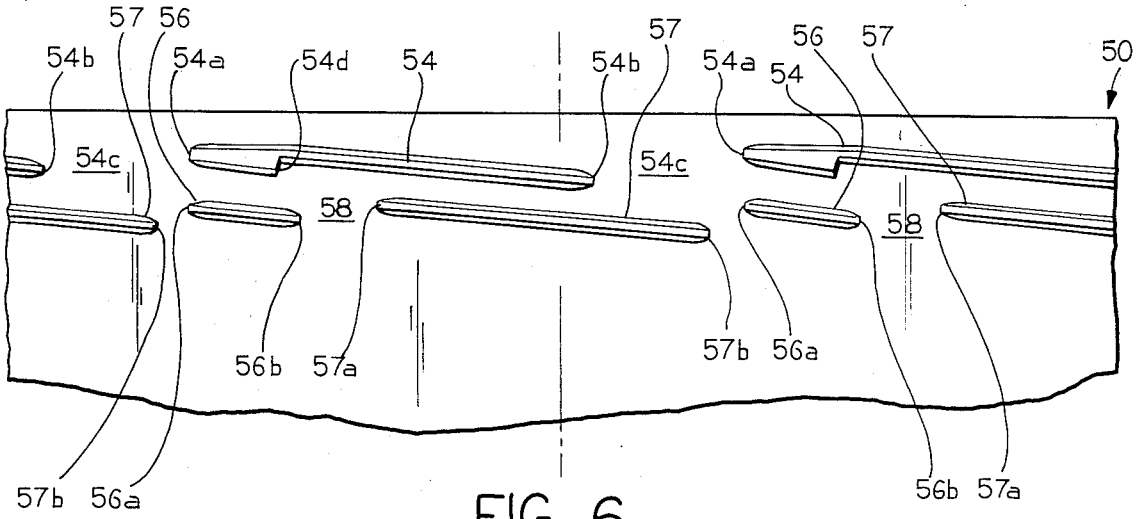
FIG. 6 is a fragmentary development view of the container of FIG. 5.

The finish 51 of the container 50 also has a second series of threadlike projections, which series is made of alternating long projections 56 and short projections 57. Each short projection 56 has a leading edge 56*a* and trailing edge 56*b* and each long projection 57 has a leading edge 57*a* and a trailing edge 57*b*. The threadlike projections 56 and 57 each extend at a helical angle with respect to the rim 53 of the container 50, and generally parallel to the helically extending threadlike projections 54. As shown, the trailing edge 56*b* of each short projection 56 is circumferentially spaced apart from the leading edge 57*a* of each long threadlike projection 57, to define a space 58 between each short projection 56 and the next adjacent long projection 57. Each space 58 is so oriented around the circumference of the finish 51 as to be offset from the shoulder 54*d* of the adjacent threadlike projection 54, to permit the downward vertical displacement of the top panel 21 of the closure body 20 when the shoulder 24*d* of the closure threadlike projection 24 is in abutting contact, or interference, with the shoulder 54*d* of the container threadlike projection 54, and to prevent the vertical downward displacement of the shoulder 24*d* with respect to the shoulder 54*d* when such shoulders are not in abutting contact. The series of threadlike projections that include the short projections 56 and the long projections 57 defines, with a series of threadlike projections 54, a series of generally helically extending slots therebetween, which slots engage the closure threadlike projections 24 when the closure 10 is applied to the container 50. The series of container threadlike projections that includes the short projections 56 and the long projections 57 also imparts a positive lifting effect to the closure 10 when it has been unscrewed from the container finish 51 to positively lift the closure 10 from the container 50 to assist in the removal of the closure 10 from the container 50, a feature which is of particular benefit to an adult with impaired hand function due, for example, to an injury or to arthritis. When the closure body 20 is formed by injection molding, it will be in an interfering relationship with the mold plug that is used in such injection molding process, due to the presence of the shoulders 24*d* on the closure threadlike projections 24. Thus, it will be necessary to strip the closure body 20 from such injection molding plug, a feature which, for practical purposes, limits the use of such a closure body to a container whose finish dimension is at least 33 millimeters in diameter, or 16.5 millimeters in radius as measured from the vertical central axis of the container 50. It is also to be noted that the closure 10, because of the multiple thread start closure thread formed by the closure threadlike projections 24, will be pulled down tightly against the rim 53 of the container finish 51 at four (4) points, assuming a two-start closure thread as illustrated, to provide good balance and flatness of the closure top panel 21 when it is tightly applied to the finish 51 of the container 50. It is also to be noted that the positive lift off of the closure 10 from the finish 51 of the container 50, that is provided by the second series of closure threadlike projections that is made up of the short projections 56 and the long projections 57, will permit the substitution of a molded plug liner, if and when such a liner would otherwise be advantageous, it being noted that closures with molded plug liners are normally more difficult to remove from the associated container than closures with flat, or disk-type liners, such as the liner 40 of the closure of the present invention. Such a molded plug closure liner would make the package that includes a closure and a container of the present invention even more resistant to the spillage or leakage of the liquid contents than the closure illustrated in FIGS. 2, 3, and 4, especially when partially rotated to the position illustrated in FIG. 8. However, the springiness of the closure liner 40 should help to minimize the leakage or spillage of the liquid contents of the container 50, even when the closure 10 is partially unscrewed from the position illustrated in FIG. 7 to the position illustrated in FIG. 8. The intricacy of the design of the finish 51 of the container 50 would complicate the production of the container 50 from glass by means of a g1ass blowing operation, but such a container could be readily mass produced from various plastic compositions by means of known plastic container blow molding techniques.

Although the best mode comtemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A child-resistant package comprising, in combination:

a container having a central axis and comprising an open mouth and a finish surrounding said open mouth, said finish of said container comprising:

a plurality of container thread segments, each of said plurality of container thread segments being formed integrally with said finish and projecting radially outwardly therefrom, each of said plurality of container thread segments further having a top side and an underside and extending generally longitudinally in an arc extending around said finish, said arc having a radius along said central axis of said container, the total of the arcuate extents of said plurality of container thread segments being less than 360°, whereby said plurality of container thread segments define a plurality of unthreaded finish portions extending generally circumferentially around said finish, each of said unthreaded finish portions being disposed between the adjacent ends of a pair of adjacent container thread segments of said plurality of container thread segments, the longitudinal extent of each of said plurality of container thread segments extending at a helical angle with respect to said central axis of said container, each of said plurality of container thread segments having a generally vertically extending shoulder that extends from the underside thereof; and a plurality of projections, each of said plurality of projections being formed integrally with said finish and projecting radially outwardly therefrom, each of said plurality of projections extending generally longitudinally in an arc extending around said finish, said arc having a radius along said central axis, the longitudinal extent of each of said plurality of projections extending at a helical angle with respect to said central axis of said container, the total of the arcuate extents of said plurality being less than 360° whereby said plurality of projections define a plurality of gaps between said projections, each of said gaps being disposed between the adjacent ends of an adjacent pair of said plurality of projections, said plurality of projections being disposed further from said open mouth of said container than said plurality of container thread segments and defining, with said plurality of container thread segments, a plurality of generally helically extending slots; and a closure having a central axis, said closure comprising;

a top panel removably spanning said open mouth of said container;

an annular skirt attached to and extending generally normally from said top panel, said annular skirt surrounding said finish portion of said container;

a plurality of closure thread segments, each of said plurality of closure thread segments being formed integrally with said annular skirt and projecting radially inwardly therefrom, each of said plurality of closure thread segments further having a top side and an underside and extending generally longitudinally in an arc extending around said annular skirt, each of said plurality of closure thread segments having a generally vertically extending shoulder that extends from said top side of said each of said plurality of closure thread segments, said plurality of closure thread segments being engageable with at least one of said plurality of generally helically extending slots to permit movement of said closure in a helical pattern with respect to said finish of said container, said movement of said closure with respect to said container being effective to permit said closure to be applied to said container and removed from said container, said movement of said closure with respect to said container during the removal of said closure from said container being effective to bring at least one of the vertically extending shoulders of said plurality of container thread segments into interfering contact with at least one of the vertically extending shoulders of said plurality of closure thread segments to prevent the removal of said closure from container, at least a portion of said closure being displaceable with respect to said finish to move said at least one of said vertically extending shoulders of said plurality of closure thread segments out of interfering contact with said at least one of said vertically extending shoulders of said plurality of container thread segments to permit further movement of said closure with respect to said container in a helical direction until said closure can be removed from said container; and biasing means resiliently biasing said closure with respect to said container to resiliently prevent the displacement of said at least said portion of said closure with respect to said container.

2. A package according to claim 1 wherein said top panel of said closure, said annular skirt of said closure and said plurality of closure thread segments of said closure are integrally formed in a single piece from an organic material.

3. A package according to claim 2 wherein said organic material is a thermoplastic material.

4. A package according to claim 3 wherein said thermoplastic material consists essentially of a thermoplastic material selected from the group consisting of polyethylene and polypropylene.

5. A package according to claim 1 wherein said biasing means comprises planar sealing means extending across said closure within said annular skirt and between said top panel of said closure and said open mouth of said container.

6. A package according to claim 5 and further comprising:

a liquid packaged in said container and wherein said sealing means forms liquid-tight seal between said container and said closure when said closure is securely applied to said container.

7. A package according to claim 5 wherein said biasing means further comprises:

an annular projection surrounded by said annular skirt and disposed radially interiorly of said annular skirt, said annular projection extending from said top panel of said closure and contacting a portion of said planar sealing means that is contacted by said annular projection being displaced along said central axis of said container to spring said planar sealing means and to create a biasing force therein.

8. A package according to claim 1 wherein said container is a blown glass container.

9. A package according to claim 1 wherein said container is a blow-molded thermoplastic container.

10. A package according to claim 8 wherein each of said container thread segments has an outside surface, the outside surface of each of said container thread segments lying on a part-circular curve, the part-circular curve of each of said container thread segments being centered along said central axis, the outside surface of each of said container thread segments being located at least 16.5 millimeters from said central axis.

11. A package according to claim 9 wherein each of said container thread segments has an outside surface, the outside surface of each of said container thread segments lying on a part-circular curve, the part-circular curve of each of said container thread segments being centered along said central axis, the outside surface of each of said container thread segments being located at least 16.5 millimeters from said central axis.

12. A container for use with a closure in a child-resistant package comprising, in combination:

a body having a central axis and comprising an open mouth;

a finish surrounding said open mouth, said finish comprising a plurality of thread segments, each of said plurality of thread segments being formed integrally with said finish and projecting radially outwardly therefrom, each of said plurality of thread segments further having a top side and an underside and extending generally longitudinally in an arc extending around said finish, said arc having a radius along said central axis of said body, the total of the arcuate extents of said plurality of thread segments being less than 360°, whereby said plurality of thread segments define a plurality of unthreaded finish portions extending generally circumferentially around said finish, each of said unthreaded finish portions being disposed between the adjacent ends of a pair of adjacent container thread segments of said plurality of container thread segments, the longitudinal extent of each of said plurality of container thread segments extending at a helical angle with respect to said central axis of said container, each of said plurality of container thread segments having a generally vertically extending shoulder that extends from the underside thereof; and a plurality of projections, each of said plurality of projections being formed integrally with said finish and projecting radially outwardly therefrom, each of said plurality of projections extending generally longitudinally in an arc extending around said finish, said arc having a radius along said central axis, the longitudinal extent of each of said plurality of projections extending at a helical angle with respect to said central axis of said body, the total of the arcuate extents of said plurality of projections being less than 360° whereby said plurality of projections define a plurality of gaps between said projections, each of said gaps being disposed between the adjacent ends of an adjacent pair of said plurality of projections, said plurality of projections being disposed further from said open mouth of said container than said plurality of thread segments and defining, with said plurality of thread segments, a plurality of generally helically extending slots.

13. A container according to claim 12 wherein said container is a blown glass container.

14. A container according to claim 12 wherein said container is a blow-molded thermoplastic container.

15. A container according to claim 13 wherein each of said thread segments has an outside surface, the outside surface of each of said thread segments lying on a part-circular curve, the part-circular curve of each of said container thread segments being centered along said central axis, the outside surface of each of said container thread segments being located at least 16.5 millimeters from said central axis.

16. A container according to claim 14 wherein each of said thread segments has an outside surface, the outside surface of each of said thread segments lying on a part-circular curve, the part-circular curve of each of said container thread segments being centered along said central axis, the outside surface of each of said container thread segments being located at least 16.5 millimeters from said central axis.

17. A closure having a central axis for use with a container having an open mouth and a finish surrounding said open mouth in a child-resistant package, said closure comprising in combination:

a top panel extending across said central axis and being adapted to removably span said open mouth of said container;

an annular skirt attached to and extending generally normally from said top panel, said annular skirt being adapted to surround said finish portion of said container;

a plurality of thread segments, each of said plurality of thread segments being formed integrally with said annular skirt and projecting radially inwardly therefrom, each of said plurality of thread segments further extending helically with respect to said central axis and having a top side and an underside and extending generally longitudinally in an arc extending around said annular skirt, each of said plurality of thread segments having a generally vertically extending shoulder that extends from said top side of said each of said plurality of thread segments, said plurality of thread segments being adapted to engage said finish of said container to permit movement of said closure in a helical pattern with respect to said finish of said container, said movement of said closure with respect to said container being effective to permit said closure to be applied to said container and removed from said container, said movement of said closure with respect to said container during the removal of said closure from said container being adapted to bring at least one of the vertically extending shoulders of said plurality of container thread segments into interfering contact with means on said finish of said container to prevent the removal of said closure from said container, at least a portion of said closure being adapted to be displaced with respect to said finish of said container to move said at least one of said vertically extending shoulders of said plurality of closure thread segments out of interfering contact with said container to permit further movement of said closure with respect to said container in a helical direction until said closure can be removed from said container; and biasing means adapted to resiliently bias said closure with respect to said container to resiliently prevent the displacement of said at least a portion of said closure with respect to said container.

18. A closure according to claim 17 wherein said top panel, said annular skirt and said plurality of thread segments are integrally formed in a single piece from an organic material.

19. A closure according to claim 17 wherein said organic material is a thermoplastic material.

20. A closure according to claim 19 wherein said thermoplastic material consists essentially of a thermoplastic selected from the group consisting of polyethylene and polypropylene.

21. A closure according to claim 17 wherein said biasing means comprises planar sealing means extending across said closure within said annular skirt and being adapted to lie between said top panel of said closure and said open mouth of said container.

* * * * *